US009926162B2

(12) United States Patent
Ohmori et al.

(10) Patent No.: US 9,926,162 B2
(45) Date of Patent: Mar. 27, 2018

(54) SHEET CONVEYING APPARATUS, IMAGE FORMING APPARATUS, AND SHEET POST-PROCESSING APPARATUS

(71) Applicants: Tatsuya Ohmori, Yamanashi-ken (JP); Masashi Yamashita, Yamanashi-ken (JP); Yuichi Kubota, Yamanashi-ken (JP)

(72) Inventors: Tatsuya Ohmori, Yamanashi-ken (JP); Masashi Yamashita, Yamanashi-ken (JP); Yuichi Kubota, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 0 days.

(21) Appl. No.: 15/342,679

(22) Filed: Nov. 3, 2016

(65) Prior Publication Data

US 2017/0121136 A1 May 4, 2017

(30) Foreign Application Priority Data

Nov. 4, 2015 (JP) ..... 2015-216476

(51) Int. Cl.
*B65H 29/12* (2006.01)
*B65H 43/02* (2006.01)
(Continued)

(52) U.S. Cl.
CPC ..... *B65H 29/12* (2013.01); *B41J 11/007* (2013.01); *B41J 11/0095* (2013.01); *B65H 5/38* (2013.01);
(Continued)

(58) Field of Classification Search
CPC ..... B65H 29/00; B65H 29/12; B65H 29/125; B65H 43/02; B65H 2408/11; B65H 2408/12; B65H 2515/12; B65H 2553/23; B65H 2553/232; B65H 2801/24
See application file for complete search history.

(56) References Cited

U.S. PATENT DOCUMENTS 4,258,326 A * 3/1981 Johne ..... B65H 7/04 271/258.03
5,531,434 A * 7/1996 Kerschner ..... B65H 7/125 271/263
(Continued)

FOREIGN PATENT DOCUMENTS

JP H07-221934 A 8/1995
JP 2005-104682 A 4/2005
(Continued)

*Primary Examiner* — David H Bollinger
(74) *Attorney, Agent, or Firm* — Manabu Kanesaka

(57) ABSTRACT

The present invention is to provide a sheet conveying apparatus capable of preventing detection error without causing damage on a sheet. The present post-processing apparatus includes a sheet conveying path to convey a sheet as being formed between an upper guide member and a lower guide member for guiding a sheet, and a detection portion including a second sensor as an electrostatic capacitance sensor to detect a sheet being conveyed on the sheet conveying path with output of the second sensor. The second sensor is fixed on a face of an upper guide member on an opposite side to the conveying path and the second sensor and the sheet conveying path are separated by the upper guide member.

10 Claims, 7 Drawing Sheets

(51) Int. Cl.

| | |
|---|---|
| ***B65H 29/00*** | (2006.01) |
| ***B41J 11/00*** | (2006.01) |
| ***B65H 5/38*** | (2006.01) |
| ***G03G 15/00*** | (2006.01) |

(52) U.S. Cl.
CPC ..... *B65H 29/00* (2013.01); *B65H 29/125* (2013.01); *B65H 43/02* (2013.01); *G03G 15/6529* (2013.01); *B65H 2405/1412* (2013.01); *B65H 2553/232* (2013.01); *B65H 2801/27* (2013.01); *G03G 15/6541* (2013.01); *G03G 2215/00827* (2013.01)

(56) References Cited

U.S. PATENT DOCUMENTS

| | | | | |
|---|---|---|---|---|
| 6,157,791 | A * | 12/2000 | Haines | B65H 7/02 399/23 |
| 6,486,680 | B1 * | 11/2002 | Mull | B65H 7/04 324/658 |
| 8,854,056 | B1 * | 10/2014 | Furuhira | G01N 27/22 271/227 |
| 2010/0117295 | A1 * | 5/2010 | Miyamoto | B65H 7/02 271/265.04 |

FOREIGN PATENT DOCUMENTS

| | | | |
|---|---|---|---|
| JP | 2006-064673 | A | 3/2006 |
| JP | 2009-035379 | A | 2/2009 |
| JP | 2014-009071 | A | 6/2012 |

* cited by examiner

SHEET CONVEYING APPARATUS, IMAGE FORMING APPARATUS, AND SHEET POST-PROCESSING APPARATUS

BACKGROUND OF THE INVENTION

Technical Field

The present invention relates to a sheet conveying apparatus, an image forming apparatus, and a sheet post-processing apparatus, and in particular, relates to a sheet conveying apparatus including a conveying path that conveys a sheet and a detecting portion that detects a sheet conveyed on the conveying path, an image forming apparatus including the sheet conveying apparatus and an image forming portion that forms an image on a sheet, and a sheet post-processing apparatus including the sheet conveying apparatus and a post-processing portion that performs post-processing on a sheet.

Description of the Related Art

Conventionally, there have been widely known an image forming apparatus such as a copier, a facsimile, and a complex machine, and a sheet post-processing apparatus to perform a stapling process, a punching process, or the like on sheets on which images are formed by an image forming apparatus. The image forming apparatus and the sheet post-processing apparatus described above incorporates a sheet conveying apparatus that includes a conveying path to convey a sheet and a detecting portion that detects a sheet being conveyed on the conveying path with a sensor.

In general, a conveying path is formed as a space between a pair (e.g., two) of guide members and a plurality of conveying roller pairs are arranged thereon. Such a roller pair is structured with a driving roller and a driven roller. Rotational drive force is transmitted to the driving roller from a power source such as a motor through a gear or a belt. The driven roller is arranged to be contacted to the driving roller.

A detecting portion that detects a sheet being conveyed on the conveying path is arranged at the conveying path. In general, the detecting portion includes a sensor. Various types of sensors exist and are roughly classified into contact type sensors and non-contact type sensors. Typical examples of contact type sensors include lever type sensors and typical examples of non-contact sensors include optical sensors each including a light emitting element and a light receiving element and ultrasonic sensors using ultrasonic.

For example, Japanese Patent Application Laid-open No. 7-221934 discloses a lever type sensor that detects a sheet being conveyed with a lever moved down by being pushed by a sheet. Further, Japanese Patent Application Laid-open No. 2006-64673 discloses a transmission type optical sensor and Japanese Patent Application Laid-open No. 2009-35379 discloses a reflection type optical sensor. Further, Japanese Patent Application Laid-open No. 2005-104682 discloses an ultrasonic sensor that detects a sheet being conveyed using ultrasonic.

SUMMARY OF THE INVENTION

With the contact type sensor disclosed in Japanese Patent Application Laid-open No. 7-221934, since a sheet being conveyed is detected by the lever moved down by the sheet, there have been problems that time delay occurs until the lever is moved down and detection timing is shifted as the lever is worn across the ages. Further, since the lever is contacted to a sheet, there may be a fear that a sheet is damaged and jamming occurs in a conveying path.

Meanwhile, in the non-contact type sensors disclosed in Japanese Patent Application Laid-open No. 2006-64673, Japanese Patent Application Laid-open No. 2009-35379, and Japanese Patent Application Laid-open No. 2005-104682, it is required that a hole or a cutout for detecting a sheet is formed, at a position on a sensor axis or in the vicinity of the position, at a guide member that structures a conveying path. In this case, when using a transmission type optical sensor or a transmission type ultrasonic sensor, a penetration hole or a cutout is formed at each of two guide members that structure a conveying path. In contrast, when using a reflection type optical sensor or a reflection type ultrasonic sensor, a penetration hole or a cutout is required to be formed only at one of two guide members. However, area of the penetration hole or the cutout becomes large compared to the case of using a transmission type optical sensor or a transmission type ultrasonic sensor. Accordingly, with a conventional non-contact sensor, there have been problems of sheet damage and sheet jamming caused by that a sheet being conveyed is stuck to the penetration hole or the cutout formed at the guide member. Further, since paper powder is likely to be generated by frictioning of a sheet being conveyed with an edge of the penetration hole or the cutout and the paper powder adheres directly to the sensor as passing through the penetration hole or the cutout, there is a fear that sheet detection errors are caused.

The present invention provides a sheet conveying apparatus, an image forming apparatus, and a sheet post-processing apparatus that are capable of solving the above problems.

In view of the above, the present invention according to a first aspect provides a sheet conveying apparatus including a conveying path to convey a sheet as being formed between a pair of guide members to guide a sheet, and a detecting portion to detect a sheet being conveyed on the conveying path as having an electrostatic capacitance sensor. Here, the electrostatic capacitance sensor or at least an electrode member of the electrostatic capacitance sensor is fixed on a face of one guide member of the pair of guide members on an opposite side to the conveying path or on a member that is arranged in the vicinity of the face on the opposite side, and the electrostatic capacitance sensor or at least the electrode member of the electrostatic capacitance sensor and the conveying path are separated by the one guide member.

In the first aspect, it is preferable that, at the one guide member, neither a hole nor a cutout to provide communication between the face on the opposite side to the conveying path and a face on a side of the conveying path is formed at a position where the electrostatic capacitance sensor or the electrode member is fixed or in the vicinity of the position. Here, it is also possible that the electrostatic capacitance sensor or the electrode member is fixed on the face of the one guide member on the opposite side to the conveying path or on the member that is arranged in the vicinity of the face on the opposite side as having the same inclination as the conveying path. Further, it is also possible that ribs protruded from the face on the opposite side to the conveying path are formed on the one guide member along a sheet conveying direction of the conveying path, and the electrostatic capacitance sensor or the electrode member is fixed on a flat face of the one guide member between the ribs on the opposite side to the conveying path or on a flat face of the member that is arranged in the vicinity of the flat face between the ribs on a side facing the opposite side.

Further, it is also possible that the electrode member is formed of a copper foil tape with adhesive provided on one face of copper foil, and the copper foil tape is attached with the adhesive to the face of the one guide member on the opposite side to the conveying path. Here, it is preferable that the one guide member is made of resin.

Further, for detecting a sheet skew amount and a sheet size, it is also possible that the detecting portion includes a plurality of electrostatic capacitance sensors, and electrode members of the electrostatic capacitance sensors are arranged as being distanced in a direction intersecting with a sheet conveying direction of the conveying path.

Furthermore, in view of the above, the present invention according to a second aspect provides an image forming apparatus including an image forming portion to form an image on a sheet and the sheet conveying apparatus of the first aspect. The present invention according to a third aspect provides a sheet post-processing apparatus including a post-processing portion to perform a post-process on a sheet and the sheet conveying apparatus of the first aspect.

According to the present invention, since the electrostatic capacitance sensor or the electrode member is fixed on the face of the one guide member of the pair of guide members on an opposite side to the conveying path or on the member that is arranged in the vicinity of the face on the opposite side, it is possible to obtain an effect that attaching of the sensor can be easily performed and ease of assembling can be enhanced. Further, since a sheet being conveyed is not contacted to the electrostatic capacitance sensor or the electrode member, it is possible to obtain an effect that the sheet is not damaged. Furthermore, since the electrostatic capacitance sensor or at least the electrode member and the conveying path are separated by the one guide member, it is possible to obtain an effect to prevent sheet jamming caused by sheet sticking and sheet detection errors caused by adhering to the sensor of paper powder that may be generated by frictioning of a sheet.

BRIEF DESCRIPTION OF THE DRAWINGS

FIGS. 3A to 3C are explanatory views schematically illustrating positions of an electrostatic capacitance sensor at a sheet conveying path, while FIG. 3A illustrates an example of an embodiment, FIG. 3B illustrates an example of another embodiment, and FIG. 3C illustrates a comparison example;

FIGS. 7A and 7B are explanatory views schematically illustrating arrangement examples of electrode members of a plurality of electrostatic capacitance sensors, while FIG. 7A illustrates an example that the electrode members are arranged as being separated in a direction intersecting with a sheet conveying direction with a longitudinal direction of the electrode members oriented in a direction along the sheet conveying direction and FIG. 7B illustrates an example that the electrode members are arranged as being separated in a direction intersecting with the sheet conveying direction with the longitudinal direction oriented in a direction intersecting with the sheet conveying direction.

DETAILED DESCRIPTION OF THE PREFERRED EMBODIMENT

Figure 1:
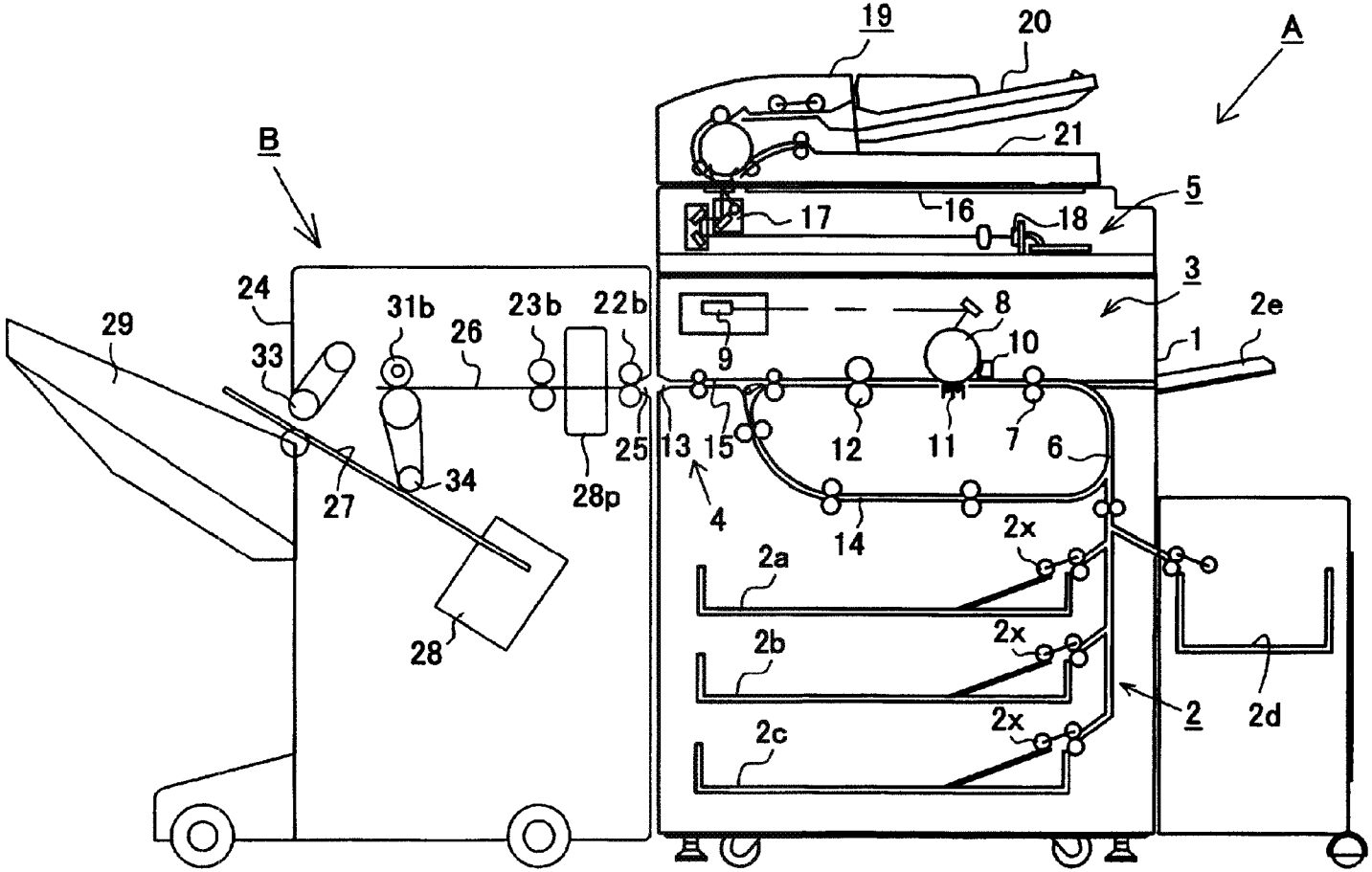
FIG. 1 is a front view of an image forming system of an embodiment to which the present invention is applicable.

In the following, embodiments obtained by applying the present invention to an image forming system will be described. FIG. 1 illustrates an image forming system of the present embodiment structured with an image forming apparatus A and a post-processing apparatus B. In the illustrated structure, the image forming apparatus A forms an image on a sheet and discharges the sheet through a sheet discharging port 13. The sheet discharging port 13 is connected to an introducing port 25 of the post-processing apparatus B, so that the image-formed sheet is introduced into the post-processing apparatus B.

A sheet conveying path 26 for conveying sheets, a processing tray 27 on which sheets are stacked into a bundle shape are arranged in the post-processing apparatus B. Image-formed sheets are stacked on a sheet placement face of the processing tray 27 through the sheet conveying path 26. The processing tray 27 is provided with a regulating stopper 32 that performs positioning of sheets at front and rear sides in a sheet discharging direction and a sheet aligning mechanism that performs positioning in a direction perpendicular to the sheet discharging direction, so that sheets are positioned at a predetermined position in a predetermined posture.

A post-processing unit 28 (stapling unit) that performs a post-process on the stacked sheets is arranged at the processing tray 27 to bind the stacked sheets into a bundle shape. A stack tray 29 is arranged at the downstream side of the processing tray 27 to store post-processed sheets thereon. In the following, description will be provided on the image forming system of the present embodiment in the order of the image forming apparatus A and the post-processing apparatus B.

(Configuration)

[Image Forming Apparatus A]

<Mechanical Section>

As illustrated in FIG. 1, the image forming apparatus A includes a sheet feeding portion 2, an image forming portion 3, and a sheet discharging portion 4 in a housing 1. Further, an image reading portion 5 and a document feeding apparatus (ADF) 19 are arranged above the housing 1 as optional units. The housing 1 is arranged as an external casing having an appropriate shape for an on-floor installation type (stand-alone type), a desk-top type, or the like.

The sheet feeding portion 2 includes a plurality of sheet feeding cassettes 2*a*, 2*b*, 2*c* (hereinafter, collectively called the feeding cassette 2*a*) that store sheets of different sizes, a high-capacity cassette 2*d* that stores generally-used sheets in large quantity, and a manual sheet feeding tray 2*e*. The sheet feeding cassette 2*a* can adopt any of various structures. In FIG. 1, the sheet feeding cassettes 2*a* incorporate a sheet placement base on which sheets are stored, a sheet feeding roller 2*x* that feeds a sheet on the sheet placement base, and a separating unit (a separating pawl, a retard member, or the like) that separates sheets one by one. Each of the cassettes 2*a* to 2*c* is mounted on the housing 1 in a detachably attachable manner.

The high-capacity cassette 2*d* is a sheet feeding unit that stores sheets to be consumed in large quantity as being mounted in the housing 1 or outside the housing as an option. The manual sheet feeding tray 2*e* feeds, in accordance with image forming timing of the image forming portion 3, sheets that are not required to be stored in a cassette or sheets that cannot be stored in a cassette such as thick sheets and specially coated sheets.

The number of the sheet feeding cassettes 2*a*, necessity of the high-capacity cassette 2*d*, and necessity of the manual sheet feeding tray 2*e* are freely selectable in accordance with apparatus specifications. In FIG. 1, the sheet feeding portion 2 includes at least two different sheet feeding mechanisms. The sheet feeding mechanisms may be structured, for example, as a combination of the first sheet feeding cassette 2*a* and the second sheet feeding cassette 2*b*, or a combination of the sheet feeding cassette 2*a* and the high-capacity sheet feeding cassette 2*d*.

A sheet feeding path 6 is arranged at the downstream side of the sheet feeding portion 2 to feed a sheet fed from the sheet feeding cassette 2*a* to the image forming portion 3 at the downstream side. The sheet feeding path 6 is provided with a conveying mechanism (conveying roller or the like) to convey a sheet and a resist roller 7 located just before the image forming portion 3. The resist roller 7 includes a pair of rollers pressure-contacted to each other, so that sheet leading end aligning (skew correcting) is performed while a sheet is curved into a loop shape with a leading end thereof abutted to the rollers in a stopped state.

As illustrated in FIG. 1, the resist roller 7 is arranged at an end part of the sheet feeding path 6 and a resist area is arranged at a path guide to curve a sheet into a loop shape. Thus, the leading end of the sheet fed from each of the sheet feeding cassettes 2*a* is aligned by the resist roller 7 and the sheet is kept waiting at the position for the timing of image forming.

The image forming portion 3 can adopt an image forming mechanism such as an ink jet printing mechanism, a silk screen printing mechanism, an offset printing mechanism, and an ink ribbon printing mechanism. The image forming portion 3 in FIG. 1 is an electrostatic image forming mechanism. A print-head 9 (laser light emitting device) and a developing device 10 are arranged around a photosensitive drum 8. A surface of the photosensitive drum is formed of photoreceptor to have different electrostatic characteristics in accordance with light. A latent image is formed on the surface by the print-head 9 and toner ink adheres thereto with the developing device 10. Concurrently, the sheet waiting at the resist roller 7 is fed toward the circumferential surface of the photosensitive drum 8 and a toner image is transferred onto the sheet by a charger 11. The toner image is fixed by a fixing device 12 and the sheet is conveyed to the sheet discharging portion 4.

The sheet discharging portion 4 includes a sheet discharging path 15 that guides the sheet having an image formed by the image forming portion 3 to a sheet discharging port 13 formed at the housing 1. A duplex path 14 is arranged at the sheet discharging portion 4, so that the sheet having an image formed on the front face thereof is guided again to the resist roller 7 after being face-reversed. Then, after an image is formed on the back face of the sheet by the image forming portion 3, the sheet is guided to the sheet discharging port 13 from the sheet discharging path 15. The duplex path 14 includes a switchback path to invert the conveying direction of the sheet fed from the image forming portion 3 and a U-turn path to face-reverse the sheet. In FIG. 1, the switchback path includes the sheet discharging path 15 and the sheet conveying path 26 of the post-processing apparatus B.

The image reading portion 5 in FIG. 1 includes a reading platen 16, a reading carriage 17 that reciprocates along the reading platen 16, and a photoelectric conversion element 18. A light source lamp (not illustrated) is built in the reading carriage 17 so that a sheet document set on the platen 16 is irradiated with reading light. Reflection light from the document is concentrated on the photoelectric conversion element 18 through a collecting lens. With such a structure, the document set on the reading platen 16 is scanned by the carriage 17 and converted into electric signals by the photoelectric element 18. The electric signals are sent to a later-mentioned image forming control portion 42 (see FIG. 5) as image data.

A document feeding device 19 is installed on the image forming apparatus A. The document feeding device 19 separates documents set on the sheet feeding tray 20 one by one and guides to the reading platen 16. The document image-read at the reading platen 16 is stored on a sheet discharging tray 21. The image forming apparatus A includes a touch panel (not illustrated) by which a sheet size an operator desires, a sheet feeding cassette for feeding, and image forming in color or black-and-while can be specified (input) while statuses and the like of the image forming apparatus A are displayed.

<Controlling Section>

Further, the image forming apparatus A includes a control portion 40 (hereinafter, called a main-body control portion to be discriminated from a later-mentioned control portion of the post-processing apparatus B) that performs whole control of the image forming apparatus A and communicates with the control portion of the post-processing apparatus B.

Figure 5:
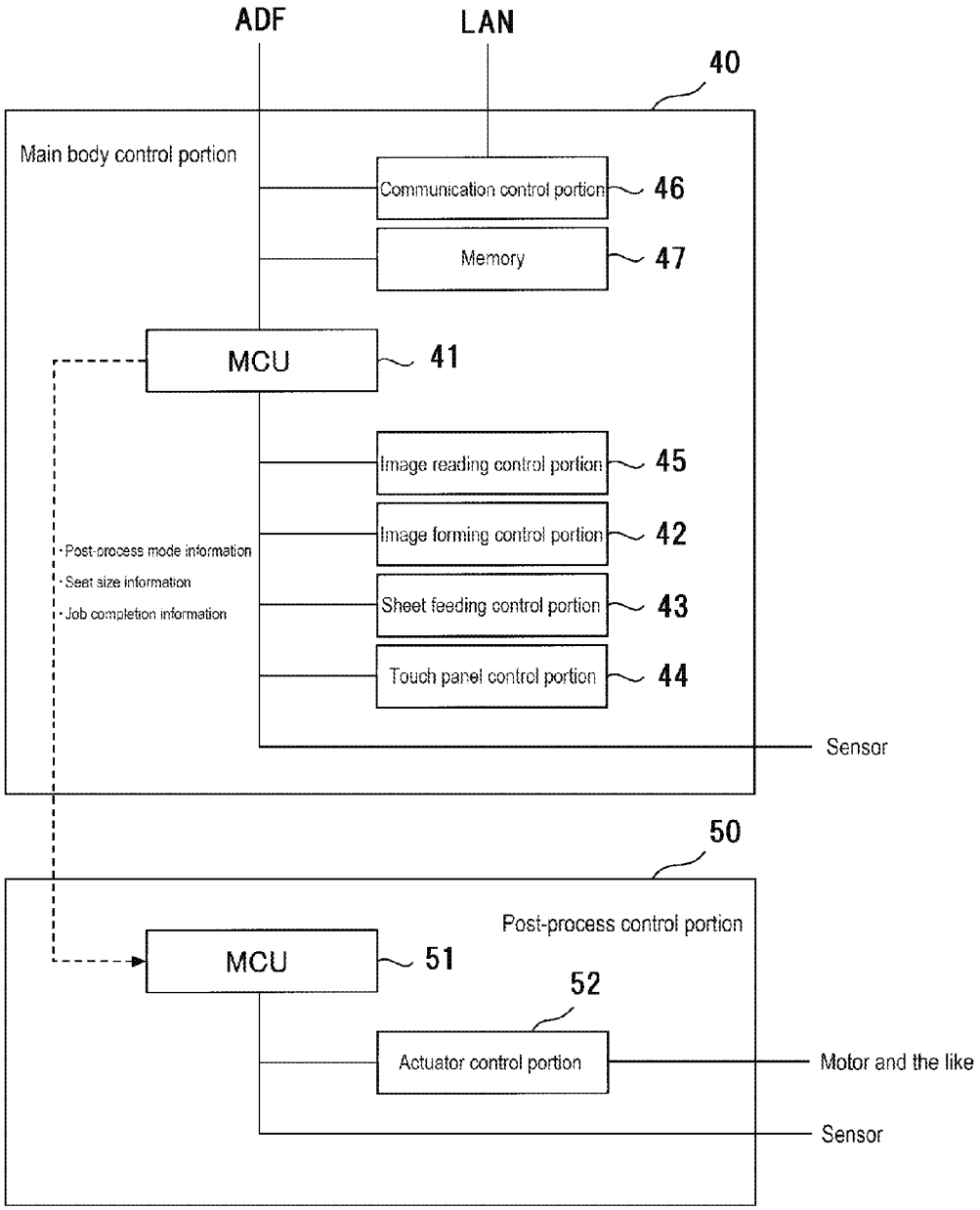
FIG. 5 is a block diagram of a control portion of the image forming system.

As illustrated in FIG. 5, the main-body control portion 40 includes an MCU 41 that incorporates a CPU, a ROM, a RAM, and the like. The MCU 41 is connected to an image reading control portion 45 that controls operation of the image reading portion 5, the image forming control portion 42 that controls operation of the image forming portion 3, a sheet feeding control portion 43 that controls operation of the sheet feeding portion 2, and a touch panel control portion 44 that controls the above-mentioned touch panel.

Further, the MCU 41 is connected to a plurality of (sensor control portions of) sensors that are arranged at the sheet feeding path 6, the duplex path 14, the sheet discharging path 15, and the like. Furthermore, the MCU 41 is connected to a communication control portion 46 that enables LAN connection, and a high-capacity memory 47 that functions as a buffer, as well as the abovementioned document feeding device 19 through an interface (not illustrated).

[Post-Processing Apparatus]

Figure 2:
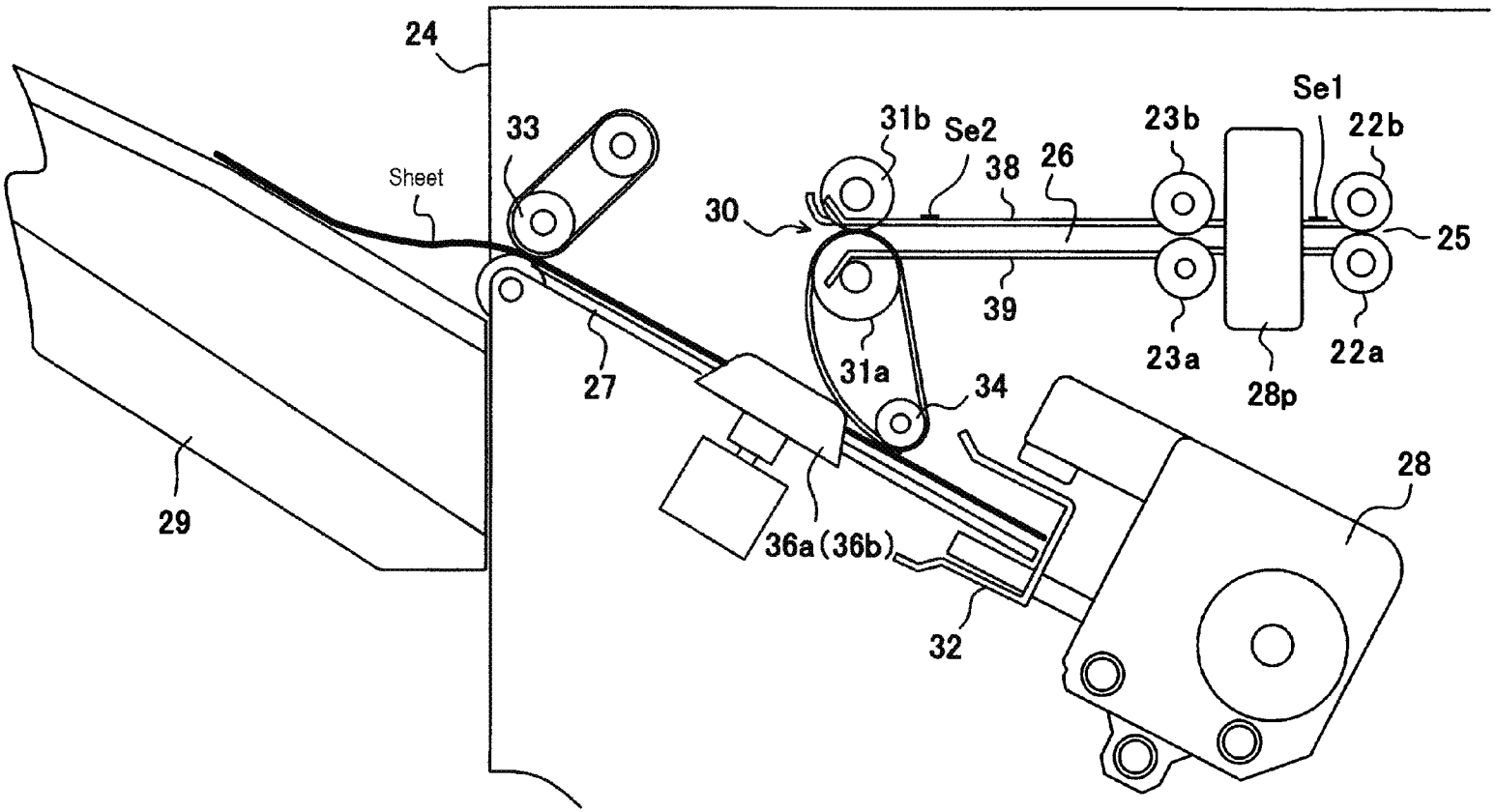
FIG. 2 is a post-processing apparatus in the image forming apparatus of the embodiment.

The post-processing apparatus B is arranged continuously connected to the image forming apparatus A to be connected to the sheet discharging port 13. As illustrated in FIG. 2, the post-processing apparatus B includes a casing 24, a sheet conveying path 26 that includes the introducing port 25 and a sheet discharging port 30 arranged at the casing 24, the processing tray 27 that temporarily stores sheets fed through the conveying path 26 for post-processing, a post-processing unit 28 that is arranged at the processing tray 27, and the stack tray 29 that stores post-processed sheets.

The introducing port 25 is arranged at a position continuously connected to the sheet discharging port 13 of the image forming apparatus A. The sheet discharging port 30 is arranged as forming a step above the processing tray 27. The processing tray 27 is arranged to bridge-support a sheet with the stack tray 29 that is arranged at the downstream side. That is, the stack tray 29 supports a leading end side of a sheet fed through the sheet discharging port 30 (to be exact, the uppermost stacked sheet) and the processing tray 27 supports a tailing end side thereof.

The stack tray 29 is structured with a lifting-lowering tray as being height-adjustable with a lifting-lowering mechanism (not illustrated) so that the uppermost stacked sheet is to be approximately on the same plane as the sheet supported by the processing tray 27.

<Sheet Conveying Path>

The sheet conveying path 26 is formed by a gap between a pair of guide members that guide a sheet, that is, between an upper guide member 38 arranged at the upper side and a lower guide member 39 arranged at the lower side. The sheet conveying path 26 forms an approximately linear path arranged in the casing in the horizontal direction.

Figure 6:
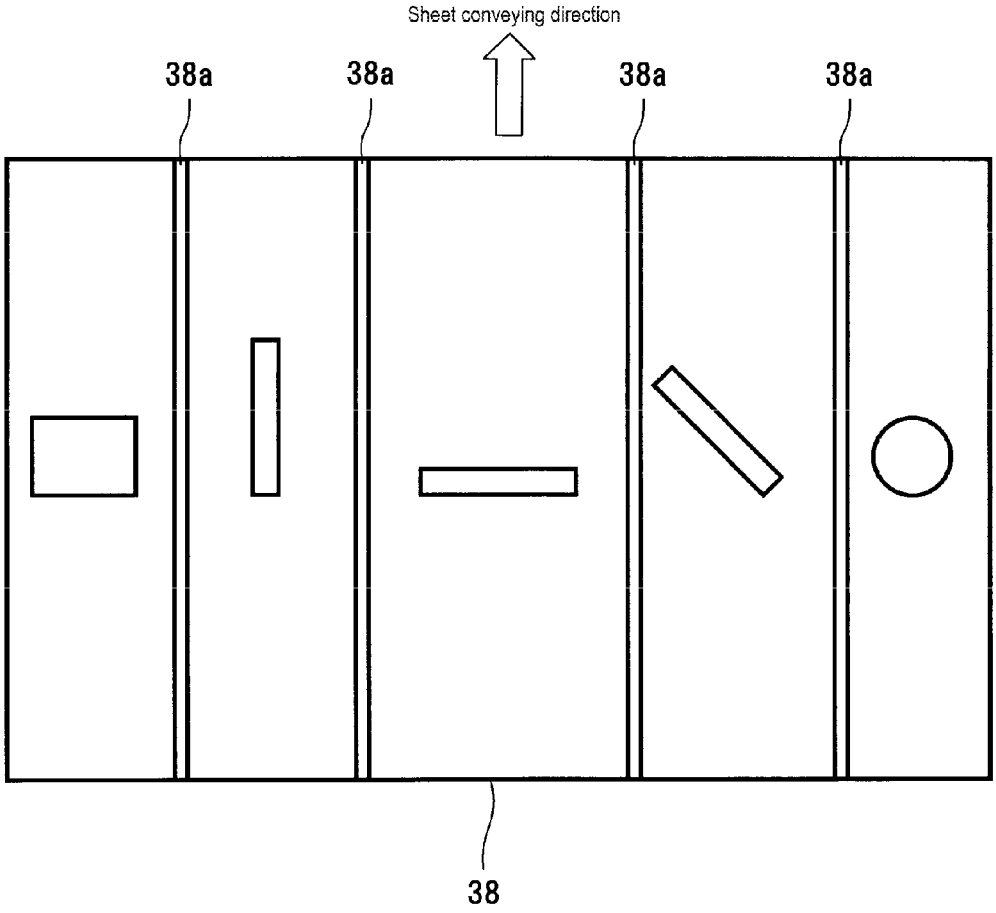
FIG. 6 is an explanatory view schematically illustrating an arrangement example of the electrostatic capacitance sensor.

The guide members 38, 39 are formed of resin. A plurality of ribs 38*a* are formed at the upper guide member 38 protruded upward from a face thereof on the opposite side to the sheet conveying path 26 in a direction along the sheet conveying direction of the sheet conveying path 26 (see FIG. 6 as well). Similarly, a plurality of ribs are formed at the lower guide member 39 protruded downward from the face thereof on the opposite side to the sheet conveying path 26 in the direction along the sheet conveying direction of the sheet conveying path 26. These ribs are arranged to reinforce the guide members 38, 39 (e.g., to prevent bending thereof).

A punch unit 28*p* that punches file holes in a fed sheet is arranged at the sheet conveying path 26 on the downstream side of an introducing roller 22. A plurality of conveying rollers are arranged at the sheet conveying path 26 to convey a sheet from the introducing port 25 toward the sheet discharging port 30. That is, the introducing roller 22 is arranged at the introducing port 25, the conveying roller 23 is arranged at the downstream side of the punch unit 28*p* in the sheet conveying direction, and a sheet discharging roller 31 is arranged in the vicinity of the sheet discharging port 30. Among these rollers, rollers 22*a*, 23*a*, 31*a* arranged at the lower side are driving rollers to which rotational drive force is transmitted from a motor (not illustrated) through gears and rollers 22*b*, 23*b*, 31*b* arranged at the upper side are driven rollers.

<Sensor>

A first sensor (inlet sensor) Se1 that detects a sheet being conveyed to be introduced to the post-processing apparatus B is arranged at the downstream side of the introducing roller 22 and the upstream side of the punch unit 28*p*. A second sensor (sheet discharge sensor) Se2 that detects a sheet being conveyed to be discharged from the sheet conveying path 26 is arranged in the vicinity of the sheet discharging port 30 (at the upstream side of the sheet discharging roller 31).

Figure 3A:
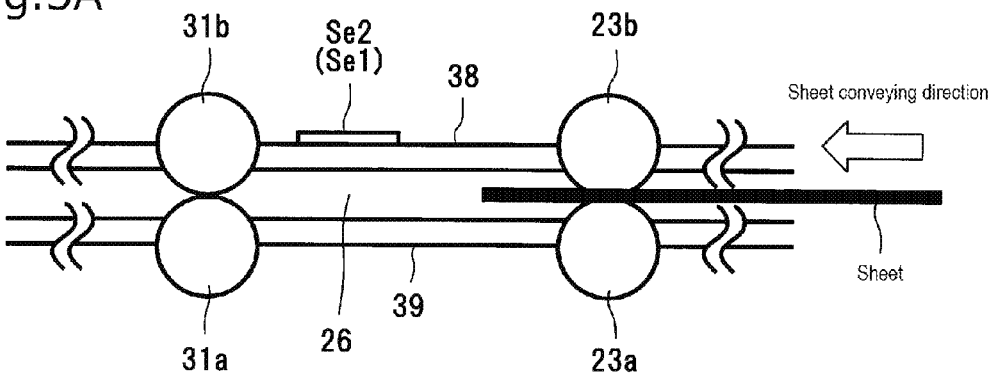

A flat-type electrostatic capacitance sensor having separated electrodes (to be exact, an electrostatic proximity sensor) is used as each of the first sensor Se1 and the second sensor Se2. As illustrated in FIG. 3A, the second sensor Se2 is fixed on the face, on the opposite side to the sheet conveying path 26, of the upper guide member 38 among the two guide members 38, 39 that structure the sheet conveying path 26. Similarly, the first sensor Se1 is fixed on the face of the upper guide member 38 on the opposite side to the sheet conveying path 26. Further, the second sensor Se2 (as well as the first sensor Se1) and the sheet conveying path 26 are separated by the upper guide member 38. At the upper guide member 38, neither a hole nor a cutout to provide communication between the face on the sheet conveying path 26 and the face opposite thereto (to penetrate to the face on the sheet conveying path 26 from the face opposite thereto) is formed at a position where the second sensor Se2 (as well as the first sensor Se1) is fixed or in the vicinity thereof.

Figure 4:
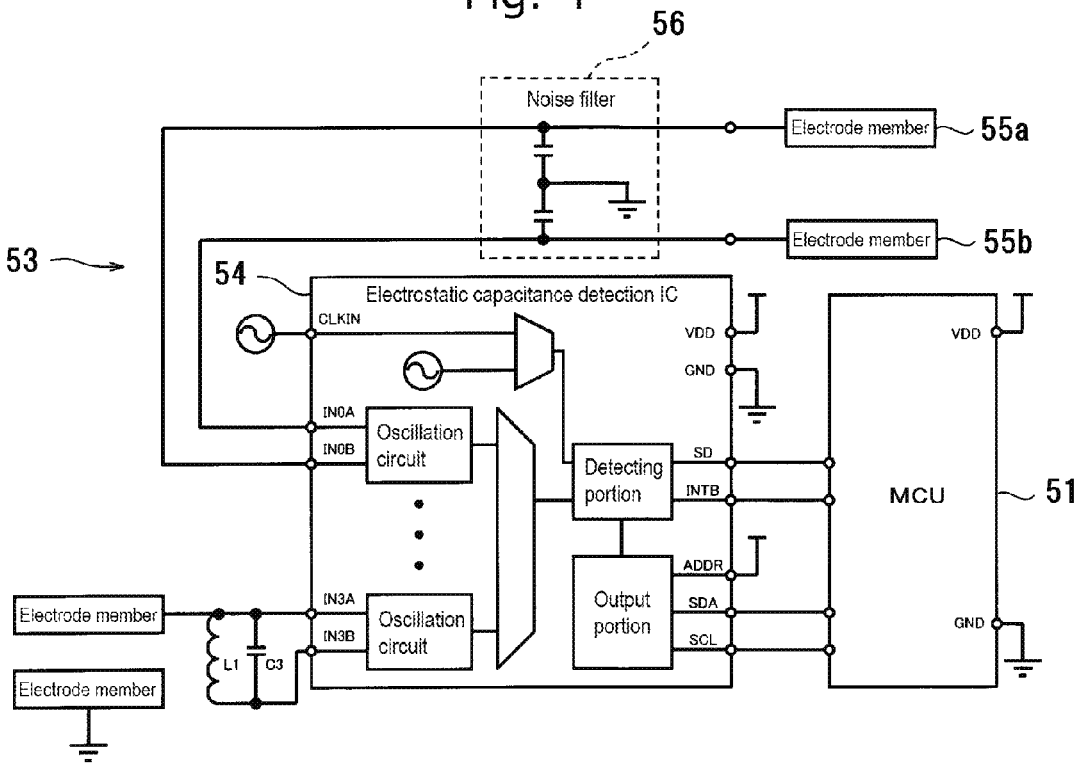
FIG. 4 is a block circuit diagram of the electrostatic capacitance sensor.

FIG. 4 illustrates a block circuit diagram of the first sensor Se1 and the second sensor Se2 each structured as an electrostatic capacitance sensor. The electrostatic capacitance sensor detects variation of electrostatic capacitance between electrodes when an object (e.g., a sheet being conveyed) approaches the electrodes. Details thereof will be described in the following. Since the first sensor Se1 and the second sensor Se2 have the same circuit structure, description will be provided on the structure of the first sensor Se1 while description on that of the second sensor Se2 will be skipped.

The first sensor Se1 includes electrode members 55*a*, 55*b* (hereinafter, called an electrode member 55 when called collectively) and a sensor control portion 53. In the present embodiment, the electrode member 55 is formed as a copper foil tape obtained by providing adhesive on one face of copper foil and is connected to the sensor control portion 53 through a conductive harness (lead wire).

The sensor control portion 53 includes a noise filter 56 that eliminates noise superimposed on the harness and an electrostatic capacitance detection IC 54 that detects variation of electrostatic capacitance between the electrode members 55*a*, 55*b*. The noise filter 56 and the electrostatic capacitance detection IC 54 are mounted on a single flexible substance.

The electrostatic capacitance detection IC 54 includes an oscillation circuit, a detecting portion, and an output portion. The oscillation circuit is a high frequency CR oscillation type and is connected to the electrode members 55*a*, 55*b* through the noise filter 56. The oscillation circuit is configured so that the electrostatic capacitance between the electrode members 55 serves as an element of oscillation conditions. Based on variation of the electrostatic capacitance (voltage value) between the electrode members 55 caused by a sheet approaching the electrode members 55, the detecting portion detects the electrostatic capacitance (voltage value) between the electrode members 55. The output portion outputs the detected electrostatic capacitance (voltage value) to an MCU 51 through serial communication in accordance with instructions of the MCU 51 described later. Examples of such serial communication include an $I^2C$ communication type.

The present embodiment includes two structural lines prepared by coupling the electrode members 55*a*, 55*b* using capacitors and ground and each of the structural lines is connected to the electrostatic capacitance detection IC 54. The electrostatic capacitance detection IC 54 transmits pulsed voltage through one side and detects the electrostatic capacitance (voltage value) occurring with respect to the other side from the side through which the pulsed voltage is not transmitted.

The electrode members 55 and the sensor control portion 53 are attached with adhesive to a flat face of the upper guide member 38 between the ribs 38 on the opposite side to the sheet conveying path 26. A double-face tape is provided at a plurality of positions on the upper guide member 38 side of the flexible substrate on which the sensor control portion 55 is mounted. Then, the flexible substrate with a release paper released is attached to the flat face of the upper guide member 38 between the ribs 38*a*. Similarly, the electrode members 55*a*, 55*b* are attached to the flat face of the upper guide members 38 between the ribs 38*a* as a copper foil tape with a release paper released. In a case that the sheet conveying path 26 is curved, it is preferable that the electrode members 55*a*, 55*b* are arranged along the shape and curvature of the sheet conveying path 26 to keep a constant distance. When the sheet conveying path is curved, the guide member forming the sheet conveying path is curved as well. Since the electrode members are structured with a copper foil tape and adhesive, the electrode members are attached and fixed to follow the curvature of the guide member. Thus, the distance between a sheet being conveyed on the sheet conveying path and the electrode members is kept at constant and detection can be stably performed.

In FIG. 3A, the electrode members 55*a*, 55*b* and the sensor control portion 53 are illustrated integrally as the second sensor Se2. A plurality of sensors provided on the sheet feeding path 6, the duplex path 14, and the sheet discharging path 15 of the image forming apparatus A adopt the similar structure and arrangement to the second sensor Se2 (as well as the first sensor Se1).

<Processing Tray and Post-Processing Unit>

As illustrated in FIG. 2, a step is formed between the sheet discharging port 30 and the processing tray 27. A sheet is stacked while a leading end thereof is fed on the uppermost sheet on the processing tray 27 through the sheet discharging port 30 and a tailing end thereof is dropped thereon through the sheet discharging port 30. The processing tray 27 is provided with the regulating stopper 32 that performs positioning of sheets to a predetermined position, a reversing roller (forward-reverse roller) 33 that feeds sheets toward the regulating stopper 32, and a friction rotor 34.

The post-processing unit 28 illustrated in FIG. 2 includes a stapling unit that performs a binding process on sheets (i.e., bundle) stacked on the processing tray 27. Alternatively, the post-processing unit 28 may include a punching unit, a stamping unit, or the like. Accordingly, the processing tray 27 is not limited to have a structure to collate and stack sheets fed through the sheet discharging port 30 into a bundle shape (as in a case that the post-processing unit is a stapling unit). The processing tray 27 may be structured to perform a post-process one by one on sheets fed through the sheet discharging port 30 (as in a case that the post-processing unit is a stamping unit).

The reversing roller 33 has a function to transfer a sheet fed through the sheet discharging port 30 to the downstream side (left side in FIG. 2) and a function to transfer the sheet toward the regulating stopper 32 after a tailing end of the sheet is dropped on the processing tray 27 through the sheet discharging port 30. The reversing roller 33 is connected to a forward-reverse drive motor (not illustrated) and is supported by an apparatus frame to be capable of being lifted and lowered between a waiting position above the processing tray 27 and an operating position on the processing tray 27. Then, the reversing roller 33 is vertically moved between the waiting portion and the operating position by a lifting-lowering motor (not illustrated).

The reversing roller 33 is located at the above waiting position until a leading end of a sheet enters onto the processing tray 27 through the sheet discharging port 30 and is lowered onto the sheet to feed the sheet toward the stack tray 29 as being rotated in the sheet discharging direction after the leading end of the sheet arrives at a position of the reversing roller 33. After a tailing end of the sheet is dropped onto the processing tray 27 through the sheet discharging port 30, the reversing roller 33 is rotated in a direction (counterclockwise direction in FIG. 2) opposite to the sheet discharging direction. After the tailing end of the sheet is bit by the friction rotor 34, the reversing roller 33 is lift from the operating position for being engaged with the sheet to wait at the waiting position. The rotation of the reversing roller 33 is stopped around the time of the above operation.

The friction rotor 34 includes a rotor that performs conveying as raking a tailing end of a sheet dropped onto the processing tray 27 through the sheet discharging port 30 and conveys the tailing end of the sheet toward the regulating stopper 32. The friction rotor 34 is structured with a flexible belt (a timing belt, a ring-shaped belt, etc.), a lifting-lowering roller axially supported by an arm member (bracket) that vertically swings, or the like. This is for vertically moving in accordance with a height position of sheets stacked on the processing tray 27.

The regulating stopper 32 includes a stopper piece having an abutting-regulating face located at a rear end of the processing tray 27. The regulating stopper 32 includes a plurality of stopper pieces as being distanced to each other in relation with moving operation of the post-processing unit (stapling unit) 28.

The sheet fed to the sheet discharging port 13 of the image forming apparatus A as described above is conveyed to the sheet conveying path 26 of the post-processing apparatus B and is stored on the processing tray 27 through the sheet discharging port 30. After a post process is performed at the processing tray 27, the sheets are stored on the stack tray 29 at the downstream side. The processing tray 27 is provided with the regulating stopper 32 that regulates a sheet end and an aligning mechanism that causes a posture of a sheet in the width direction to be aligned with a reference line.

The aligning mechanism includes a right-left pair of aligning members 36*a*, 36*b* and an aligning motor that moves the aligning member 36 in the sheet width direction. The aligning member 36 is configured to be movable among a home position defined by an initial setting process at the time of being powered, a waiting position, and an aligning position. The waiting position is defined in accordance with a sheet size at a position between the home position and the aligning position. The reason why the waiting position is determined in addition to the home position is to lessen movement distance of the aligning member 36, that is, to shorten a processing time of the aligning process. Each of the right-left pair of aligning members 36*a*, 36*b* includes an aligning face that is engaged with a sheet side edge. The aligning face is formed in parallel to a reference line (center reference or side reference). Details of such an aligning mechanism are disclosed in, for example, Japanese Patent Application Laid-open No. 2014-9071.

<Control Portion>

As illustrated in FIG. 5, a control portion (hereinafter, called a post-process control portion for discriminating from the main body control portion 40) 50 includes the MCU 51 that incorporates a CPU, a ROM, a RAM, and the like. The MCU 51 is connected to an actuator control portion 52. The actuator control portion 52 is connected to a variety of actuators such as a motor and a plunger (not illustrated). Further, as illustrated in FIG. 4, the MCU 51 is connected to the first sensor Se1 and the second sensor Se2 as well.

The MCU 51 of the post-process control portion 50 communicates with the MCU 41 of the main body control portion 40 so as to receive, from the MCU 41, information necessary for performing control by the post-processing apparatus B such as post-process mode information, seat size information, and job completion information.

(Operation)

Next, description of the image forming system of the present embodiment will be described mainly on the MCU 41 of the main body control portion 40 and the MCU 51 of the post-process control portion 50. Since individual operation of each structural member is described above, brief description will be provided on a case, as an example, that an operator specifies a staple process as a post-process mode via a touch panel.

[Image Forming Apparatus]

When a start button on the touch panel is depressed by an operator, the MCU 41 reads information input via the touch panel through a touch panel control portion 44 and causes the image reading portion 5 through the image reading control portion 45 to read a document. Further, through the sheet feeding control portion 43, a pick-up roller 2*x* of the sheet feeding cassette desired by the operator is rotated to feed a sheet and the conveying roller on the sheet feeding path 6 is driven. Accordingly, the fed sheet is conveyed on the sheet feeding path 6 toward the resist roller 7.

A sensor is provided on the upstream side of the resist roller 7. After the sensor detects a leading end of a conveyed sheet, the resist roller 7 is kept in a rotationally-stopped state for a predetermined time. Accordingly, aligning at a leading end of the sheet is performed.

After elapse of the predetermined time, MCU 41 causes the resist roller 7 and other conveying rollers to be rotationally driven and causes, through the image forming control portion 42, respective portions that structure the image forming portion 3 to be operated so that an image is formed on a sheet and the sheet is discharged from the sheet discharging port 13 through the sheet discharging path 15. In advance of operation of the image forming portion 3, the MCU 41 obtains image information of a document as causing the document feeding device 19 and the document reading device 5 to be operated in accordance with instruction of the operator and controls the image forming control portion 42 so that an image is formed on the sheet by the image forming portion 3 in accordance with the obtained image information.

[Post-Processing Apparatus]

In advance of post-processing by the post-processing apparatus B, the MCU 51 receives post-process mode information and seat size information from the MCU 41. When the above information is received from the MCU 41, the MCU 51 drives, through the actuator control portion 52, conveying motors that rotate the introducing roller 22, the conveying roller 23, and the sheet discharging roller 31 arranged on the sheet conveying path 26. Further, the MCU 51 determines whether or not a sheet is introduced into the sheet conveying path 26 through the introducing port 25 by monitoring output from the first sensor Se1.

Here, in a case that a punching process is included in the post-process mode information, after the conveying motor is driven for a predetermined number of steps from the timing when the first sensor Se1 detects a sheet, driving of the conveying motor is stopped. Accordingly, the sheet is sandwiched by the introducing roller 22 and the conveying roller 23 and a punching process is performed by the punch unit 28*p*. After the punching process is performed (after elapse of a predetermined time), the MCU 51 causes the conveying motor to be driven again to convey the sheet on the sheet conveying path 26 toward the downstream side.

Further, when the post-process mode information and the sheet size information are received, the MCU 51 causes the reversing roller 33 to wait at the waiting portion and monitors output from the second sensor Se2. Here, the reversing roller 33 is kept waiting at the waiting position in a state that a sheet is discharged through the sheet discharging port 30. After a leading end of a sheet passes, the reversing roller 33 is pressure-contacted thereto and rotated in the sheet discharging direction. Thereafter, at the timing when a tailing end of the sheet passes through the second sensor Se2, the rotational direction of the reversing roller 33 is reversed. The above control is executed, so that vertical movement of the reversing roller 33 is controlled by a lifting-lowering motor and positive-reverse rotation thereof is controlled by a roller drive motor. Further, based on the received sheet size information, the MCU 51 causes the right-left aligning members 36*a*, 36*b* to move from the home position to the waiting position by driving an aligning motor.

Further, based on monitoring output of the first sensor Se1 and the second sensor Se2, the MCU 51 causes a sheet to be introduced onto the processing tray 27 and causes the right-left aligning members 36*a*, 36*b* to move from the waiting position to the aligning position after elapse of an estimated time for a tailing end of the sheet to arrive at the regulating stopper 32.

When the MCU 51 receives a job completion signal from the MCU 41, the last sheet on which the job is performed is then introduced to the processing tray 27 through the sheet conveying path 26 and sheets are aligned in the width direction by driving the aligning motor. Then, the MCU 51 drives a drive motor of the post-processing unit (stapling unit) 28 through the actuator control portion 52. Thus, the post-processing unit 28 performs a binding process.

Thereafter, the MCU 51 causes a sheet bundle on the processing tray 27 to be pressure-contacted by the reversing roller 33 through the actuator control portion 52 and causes the reversing roller 33 to be rotated in a direction toward the stack tray 29. With such operation, the sheet bundle on the processing tray 27 is stored on the stack tray 29 at the downstream side.

(Effects and the Like)

Next, description will be provided on effects and the like of the image forming system of the present embodiment mainly for the sheet conveying path 26 and the first and second sensors Se1, Se2 of the post-processing apparatus B.

As illustrated in FIG. 3A, the sheet conveying portion of the post-processing apparatus B includes the sheet conveying path 26 for conveying a sheet as being structured with the upper guide member 38 and the lower guide member 39 for guiding a sheet, and the second sensor Se2 (electrostatic capacitance sensor) that detects a sheet being conveyed on the sheet conveying path 26. The second sensor Se2 is fixed on the face of the upper guide member 38 among the two guide members 38, 39 on the opposite side to the sheet conveying path 26. Accordingly, attaching of the sensor can be easily performed and ease of assembling can be enhanced. Further, since a sheet being conveyed is not contacted to the second sensor Se2 (or the electrode member 55), the sheet is not damaged. The same is applied to the first sensor Se1.

Figure 3B:
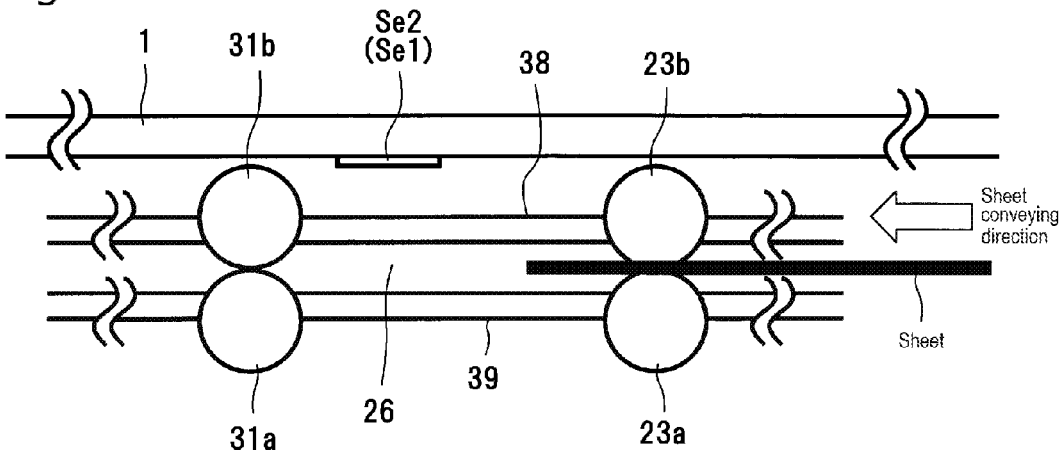
Figure 3C:
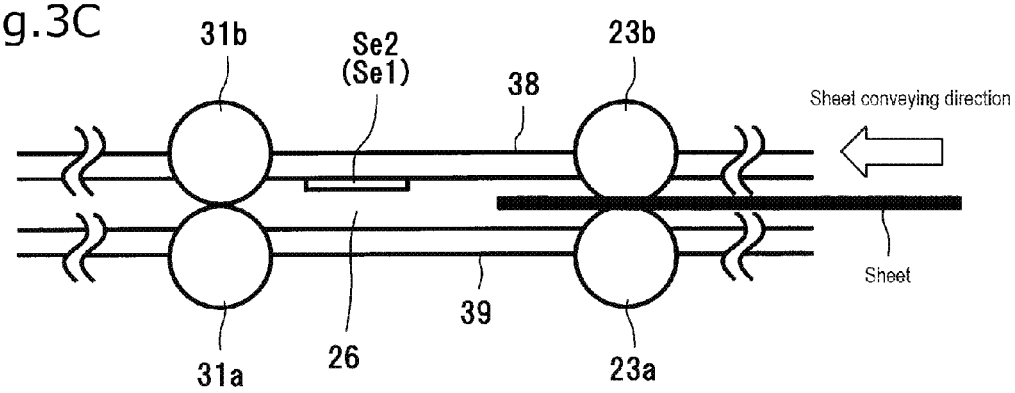

In contrast, it may be considered that the second sensor Se2 is fixed to the face on the sheet conveying path 26 side of the upper guide member 38 among the two guide members 38, 39, as illustrated in FIG. 3C. However, with the structure illustrated in FIG. 3C, since a sheet being conveyed is contacted to the second sensor Se2 (or the electrode member 55), there is a risk to cause damage on the sheet or jamming of the sheet.

Further, the second sensor Se2 (or at least the electrode member 55 in the second sensor Se2) and the sheet conveying path 26 are separated by the upper guide member 38. The above structure prevents occurrence of jamming that may occur with sticking of a sheet and occurrence of detection errors that may be occur owing to that paper powder to be generated by sheet frictioning adheres to the second sensor Se2. Compared to the related art, at the upper guide member 38, neither a hole nor a cutout to provide communication (penetration) between the face on the sheet conveying path 26 and the face opposite thereto is formed at a position where the second sensor Se2 (or the electrode member 55) is fixed or in the vicinity thereof. Accordingly, jamming that may occur with sticking of a sheet being conveyed to the hole or cutout is prevented from occurring. Further, since paper powder that may be generated by frictioning of a sheet being conveyed to the hole or cutout does not exist, detection errors that may occur with direct adhering of paper powder to the second sensor Se2 is prevented. The same is applied to the first sensor Se1 as well.

Further, the second sensor Se2 (as well as the first sensor Se1) is fixed on a flat face of the upper guide member 38 on the side opposite to the sheet conveying path 26. Accordingly, attaching operation and connecting operation with the MCU 51 can be performed from the upper side of the upper guide member 38, so that ease of assembling can be further enhanced. Furthermore, since fixing to the upper guide member 38 is performed by utilizing a flat face between the ribs 38*a*, strength of the upper guide member 38 is not impaired.

Further, the electrode members 55*a*, 55*b* are structured with a copper foil tape with adhesive provided on one face of the copper foil and are attached on a face of the upper guide member 38 on the side opposite to the sheet conveying path 26 after releasing a release paper attached to the adhesive of the copper foil tape. Accordingly, fixing operation of the electrode members 55*a*, 55*b* is easily performed. Further, the sensor control portion 53 is mounted on the flexible substrate and the flexible substrate is attached to the upper guide member 38 as well with a plurality of double-face tapes. Accordingly, fixing operation of the sensor control portion 53 is easily performed as well.

Further, since the upper guide member 38 is made of resin (nonconductive material), short-circuit to the ground does not occur even though the electrode members 55*a*, 55*b* formed of a copper foil tape are attached to the upper guide member 38. Similarly, short-circuit of the sensor control portion 53 to the ground does not occur as well.

In the example of the present embodiment, the second sensor Se2 (as well as the first sensor Se1) is fixed on the face of the upper guide member 38 among the pair (two) of the guide members 38, 39 on the opposite side to the sheet conveying path 26. However, the present invention is not limited to the above. For example, it is also possible to be fixed to the lower guide member 39. Further, such a guide member is not limited to a guide member that is arranged in the horizontal direction as the upper guide member 38 in the present embodiment. For example, it is also possible to be fixed to a guide member that is arranged vertically as the sheet feeding path 6 illustrated in FIG. 1 or to be fixed to an inclined guide member. Further, the present embodiment exemplifies the two guide members 38, 39. Here, it is also possible that either or both of the guide members 38, 39 are separated into plural pieces.

Further, it is also possible that the second sensor Se2 (as well as the first sensor Se1) is fixed to a member that is arranged in the vicinity of the face of one of the two guide members 38, 39 on the opposite side to the sheet conveying path 26. FIG. 3B illustrates an example of the above. In this example, the second sensor Se2 is fixed on a flat face of the housing 1 that faces the face of the upper guide member 38 on the opposite side to the sheet conveying path 26. Here, the flat face of the housing 1 is arranged in the vicinity of a flat face of the upper guide member 38 (between the ribs 38*a*) on the opposite side to the sheet conveying path 26. Arranging in the vicinity thereof represent that the second sensor Se2 fixed to the member arranged in the vicinity thereof is arranged in a range to be capable of detecting a sheet to be conveyed on the sheet conveying path 26. Accordingly, it is also possible to be fixed to a member that is extended from the guide member, the housing, or the like.

Further, in the example of the present embodiment, the second sensor Se2 (as well as the first sensor Se1) is fixed on the flat face of the upper guide member 38. However, the present invention is not limited to the above. For example, it is also possible to per form positioning of the flexible substrate by fitting projections formed between the ribs 38*a* of the upper guide member 38 to a plurality of holes formed at the flexible substrate. Alternatively, it is also possible to perform positioning of the electrode members 55*a*, 55*b* by forming, between the ribs 38*a* of the upper guide member 38, a groove-shaped flat face or a protruded flat face that is slightly larger than the electrode members 55*a*, 55*b*.

Further, in the example of the present embodiment, the electrode members 55*a*, 55*b* and the sensor control portion 53 of the second sensor Se2 (as well as the first sensor Se1) are fixed on the face of the upper guide member 38 on the opposite side to the sheet conveying path 26. However, it is also possible that (at least) the electrode members 55*a*, 55*b* are fixed on the face of the upper guide member 38 on the opposite side to the sheet conveying path 26 and the flexible substrate on which the sensor control portion 53 is mounted is fixed to another member (e.g., the housing 1). Such a structure is adopted, for example, when area or arrangement of the face of the upper guide member 38 on the opposite side to the sheet conveying path 26 is restricted.

Further, in the example of the present embodiment, a copper foil tape is used for the electrode members 55*a*, 55*b*. However, since detecting a sheet to be conveyed on the sheet conveying path 26 is simply required, a size, a shape, and orientation of the electrode members 55*a*, 55*b* are arranged freely without restriction as long as being formed of conductive material.

Further, the present embodiment exemplifies a sensor having separated electrodes. However, the present invention is not limited to the above. For example, it is also possible to adopt an electrode-integrated sensor in which the electrode members 55*a*, 55*b* and the sensor control portion 53 are integrated. In such a structure, the electrode members 55*a*, 55*b* may be formed of solid-like print conductor instead of copper foil as being arranged on corners of the mounted sensor control portion 53. Further, it is also possible to attach, to a guide member, a package in which such a flexible substrate is accommodated.

Further, since electrostatic capacitance sensors are used in the present embodiment, it is also possible to detect sheet ends, overlap feeding (feeding a plurality of sheets concurrently on the sheet conveying path), foreign matters, sheet thickness, sheet quality, the number of sheet bundles, sheet electrification, and the like.

Figure 7A:
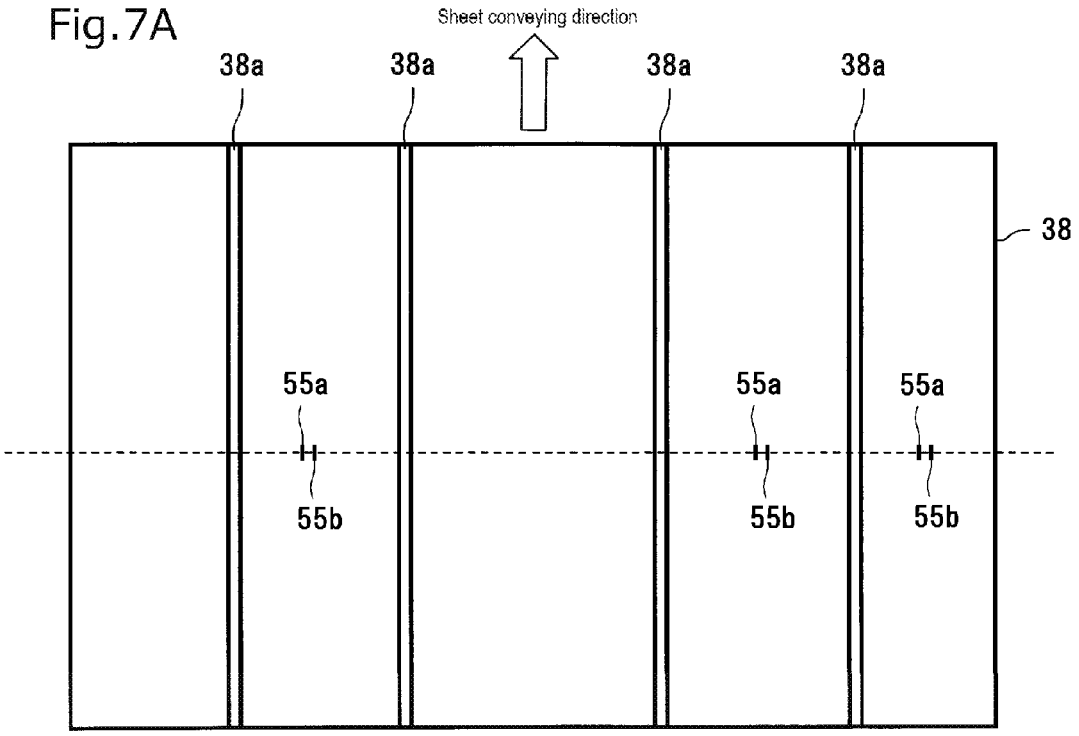
Figure 7B:
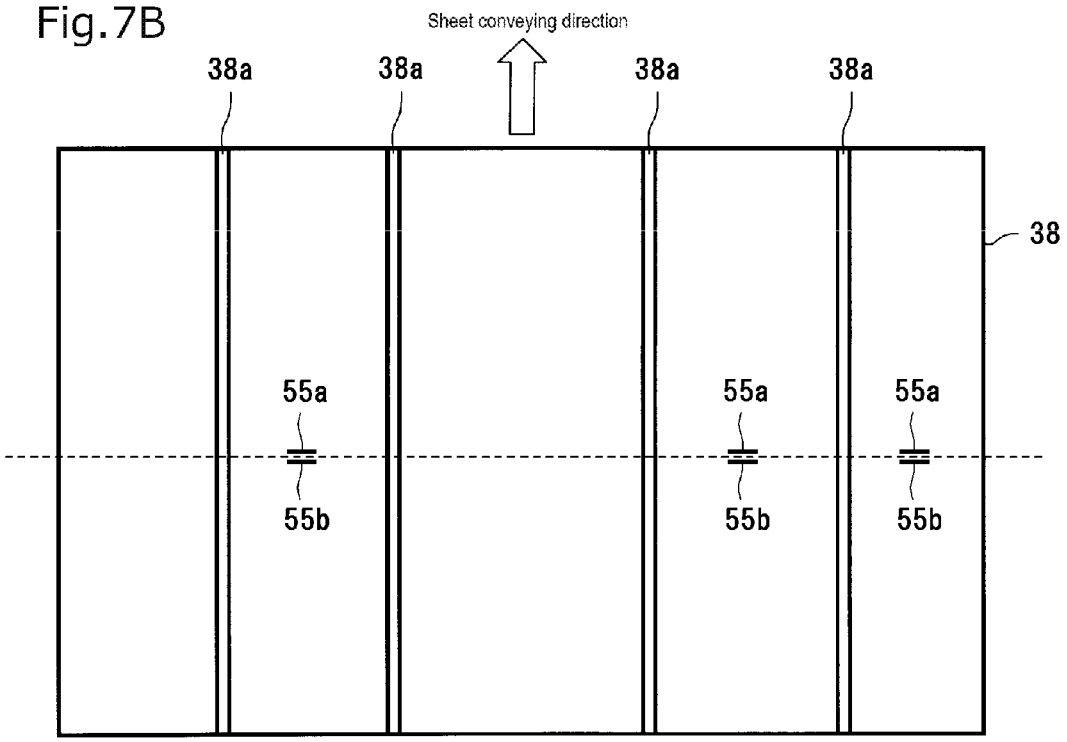

Further, since a plurality of the electrostatic capacitance sensors are used in the present embodiment, it is also possible to detect a sheet skew amount and a sheet size. Examples of the above are illustrated in FIGS. 7A and 7B. In FIGS. 7A and 7B, only the electrode members 55*a*, 55*b* of the electrostatic capacitance sensors are illustrated while the sensor control portions 53 are not illustrated.

In examples illustrated in FIGS. 7A and 7B, three electrostatic capacitance sensors are used while the electrode members 55*a*, 55*b* thereof are arranged as being distanced along a direction intersecting with the sheet conveying direction of the sheet conveying path 26. In the example of FIG. 7A, the longitudinal direction of the electrode members 55*a*, 55*b* of the respective electrostatic capacitance sensors is oriented along the sheet conveying direction. In the example of FIG. 7B, the longitudinal direction of the electrode members 55*a*, 55*b* of the respective electrostatic capacitance sensors is oriented to intersect with the sheet conveying direction. In these examples, a leading end of a sheet is detected by two pairs of the electrode members 55*a*, 55*b* symmetrically arranged with respect to the center of the upper guide member 38, and then, a skew amount is calculated using the difference of detection values. Further, a sheet size is detected by two pairs of the electrode members 55*a*, 55*b* arranged at the outer side with respect to the center of the upper guide member 38 (arranged at the right side in FIGS. 7A and 7B).

Further, the present embodiment exemplifies two structural lines prepared by coupling the electrode members 55*a*, 55*b* using capacitors and ground. However, as illustrated in FIG. 4 at the lower-left side, it is also possible that one of the two electrode members is connected to the electrostatic capacitance detection IC 54 having a structure coupled using a capacitor and the other thereof is connected to the ground. With this structure, pulsed voltage is transmitted from the one electrode member connected to the electrostatic capacitance IC 54 and electrostatic capacitance is detected through the other electrode member. Here, the ground for the other electrode member may be an electrode member connected to the ground through a harness or may be a conductive apparatus frame or a conductive guide member connected to the ground.

Further, the present embodiment exemplifies an example that the present invention is applied to the post-processing apparatus B. However, not limited to the above, the present invention is applicable to an image forming apparatus such as a copier, a facsimile and a complex machine, document feeding apparatus, and the like.

As described above, the present invention contributes to manufacturing and selling of sheet conveying apparatuses, image forming apparatuses, and sheet post-processing apparatuses by providing sheet conveying apparatuses, image forming apparatuses, and sheet post-processing apparatuses that solve problems of related art. Accordingly, the present invention has industrial applicability.

This application claims the benefit of Japanese Patent Application No. 2015-216476 which is incorporated herein by reference.

What is claimed is:

1. A sheet conveying apparatus, comprising:

a conveying path to convey a sheet as being formed between a pair of guide members to guide a sheet; and an electrostatic capacitance sensor to detect a sheet being conveyed on the conveying path, wherein at least an electrode member of the electrostatic capacitance sensor is fixed on a face of one guide member of the pair of guide members on an opposite side to the conveying path or on a member that is arranged in a vicinity of the face on the opposite side to be separated from the conveying path.

2. The sheet conveying apparatus according to claim 1, wherein, at the one guide member, neither a hole nor a cutout to provide communication between the face on the opposite side to the conveying path and a face on a side of the conveying path is formed at a position where the electrode member is fixed or in a vicinity of the position.

3. The sheet conveying apparatus according to claim 1, wherein the electrode member is fixed on the face of the one guide member on the opposite side to the conveying path or on the member that is arranged in the vicinity of the face on the opposite side as having an inclination same as the conveying path.

4. The sheet conveying apparatus according to claim 1, wherein ribs protruded from the face on the opposite side to the conveying path are formed on the one guide member along a sheet conveying direction of the conveying path, and the electrode member is fixed on a flat face of the one guide member between the ribs on the opposite side to the conveying path or on a flat face of the member that is arranged in the vicinity of the flat face between the ribs on a side facing the opposite side.

5. The sheet conveying apparatus according to claim 1, wherein the electrostatic capacitance sensor includes a plurality of electrostatic capacitance sensor members, and electrode members of each of the plurality of electrostatic capacitance sensor members are arranged as being distanced in a direction intersecting with a sheet conveying direction of the conveying path.

6. The sheet conveying apparatus according to claim 1, wherein the electrode member is formed of a copper foil tape with an adhesive provided on one face of copper foil, and the copper foil tape is attached with the adhesive to the face of the one guide member on the opposite side to the conveying path.

7. The sheet conveying apparatus according to claim 6, wherein the one guide member is made of resin.

8. The sheet conveying apparatus according to claim 1, wherein the electrostatic capacitance sensor includes the electrode member separately formed from the pair of guide members.

9. An image forming apparatus, comprising:

an image forming portion to form an image on a sheet;

a conveying path to convey a sheet as being formed between a pair of guide members to guide a sheet; and an electrostatic capacitance sensor to detect a sheet being conveyed on the conveying path, wherein at least an electrode member of the electrostatic capacitance sensor is fixed on a face of one guide member of the pair of guide members on an opposite side to the conveying path or on a member that is arranged in a vicinity of the face on the opposite side to be separated from the conveying path.

10. A sheet post-processing apparatus, comprising:

a post-processing portion to perform a post-process on a sheet;

a conveying path to convey a sheet as being formed between a pair of guide members to guide a sheet; and an electrostatic capacitance sensor to detect a sheet being conveyed on the conveying path as having an electrostatic capacitance sensor, wherein at least an electrode member of the electrostatic capacitance sensor is fixed on a face of one guide member of the pair of guide members on an opposite side to the conveying path or on a member that is arranged in a vicinity of the face on the opposite side to be separated from the conveying path.

* * * * *